US008766898B2

(12) United States Patent
Chen et al.

(10) Patent No.: US 8,766,898 B2
(45) Date of Patent: Jul. 1, 2014

(54) HIGH-ACCURACY MULTI-CHANNEL CIRCUIT

(75) Inventors: Iliana Fujimori Chen, Somerville, MA (US); David Hall Whitney, Westford, MA (US)

(73) Assignee: Analog Devices, Inc., Norwood, MA (US)

( * ) Notice: Subject to any disclaimer, the term of this patent is extended or adjusted under 35 U.S.C. 154(b) by 1230 days.

(21) Appl. No.: 12/198,538

(22) Filed: Aug. 26, 2008

(65) Prior Publication Data

US 2009/0195533 A1 Aug. 6, 2009

Related U.S. Application Data

(60) Provisional application No. 61/063,254, filed on Feb. 1, 2008.

(51) Int. Cl.
*G09G 3/36* (2006.01)

(52) U.S. Cl.
USPC ..... 345/98; 345/211

(58) Field of Classification Search
USPC ..... 341/145, 150; 345/204–206, 208, 214, 345/215, 87–104, 211–213
See application file for complete search history.

(56) References Cited

U.S. PATENT DOCUMENTS

| | | | | |
|---|---|---|---|---|
| 4,404,525 | A * | 9/1983 | Amir et al. | 330/9 |
| 6,529,152 | B1 * | 3/2003 | Piasecki et al. | 341/144 |
| 7,050,029 | B2 * | 5/2006 | Liang et al. | 345/96 |
| 7,106,318 | B1 * | 9/2006 | Liang et al. | 345/211 |
| 2002/0063703 | A1 * | 5/2002 | Furuhashi et al. | 345/212 |
| 2007/0236421 | A1 * | 10/2007 | Shin | 345/76 |
| 2007/0290979 | A1 * | 12/2007 | Lee et al. | 345/100 |

OTHER PUBLICATIONS

J. W. Yang and K. W. Martin, "High-Resolution Low-Power CMOS D/A Converter," IEEE Journal of Solid-State Circuits, pp. 1458-1461 vol. 24, No. 5, Oct. 1989.

* cited by examiner

*Primary Examiner* — Amr Awad
*Assistant Examiner* — Aaron Midkiff
(74) *Attorney, Agent, or Firm* — Kenyon & Kenyon, LLP

(57) ABSTRACT

A multi-channel circuit includes a first-channel circuit configured to receive a digital input and a second-channel output voltage, and to generate a first-channel output voltage as a function of the received digital input and second-channel output voltage.

15 Claims, 16 Drawing Sheets

HIGH-ACCURACY MULTI-CHANNEL CIRCUIT

CROSS-REFERENCE TO RELATED APPLICATIONS

This application claims priority to U.S. Provisional Patent Application No. 61/063,254, to Iliana Fujimori Chen and David Hall Whitney, filed on Feb. 1, 2008, entitled "Circuit to Deliver Accurate Relative Signals," which is herein incorporated by reference in its entirety.

BACKGROUND INFORMATION

FIG. 1 depicts a dual-channel circuit 20 capable of delivering a differential voltage to a pixel 24, of a liquid crystal display (LCD), having a switch S1 and a liquid crystal modeled as a capacitor C. The multi-channel circuit 20 includes a backplane amplification circuit 28 to deliver a backplane signal VCOM to a backplane electrode 36 of the pixel 24, and a video amplification circuit 32 to deliver a video signal VOUT to a video electrode 40 of the pixel 24. The backplane and video electrodes 36, 40 both typically have time-varying voltage requirements over the course of operation of the LCD.

FIG. 2 depicts an implementation of the dual-channel circuit 20A, in which an embodiment of the backplane amplification circuit 28A includes a first digital-to-analog converter (DAC) 44 configured to receive a first digital input DIN1, and an embodiment of the video amplification circuit 32A includes a second DAC 48 configured to receive a second digital input DIN2. In FIG. 2, the first and second DACs 44, 48 each have a plurality of resistors 38, 42 arranged in series and configured to receive first and second reference voltages VREF1, VREF2, respectively. Intermediate voltages VSEL1, VSEL2 are selected from the resistor strings by a plurality of switches 46, 50 in response to the first and second digital inputs DIN1, DIN2. The selected voltages VSEL1, VSEL2 are buffered, and optionally amplified, by output amplifiers 52, 56 to produce the backplane and video signals VCOM, VOUT.

An ideal differential-to-single-ended amplifier typically implements a transfer function that can represented by VOA=(VIA+−VIA−)*GA, where VOA is the voltage produced at an output terminal, VIA+ and VIA− are voltages received at non-inverting and inverting input terminals, respectively, and GA is the gain of the ideal amplifier. The ideal amplifier would therefore produce a zero value of the output voltage VOA in response to a zero value of the differential input voltage, VIA+−VIA−. However, as a practical reality, most amplifiers have small imperfections such as, e.g., slightly differently-sized transistors on either side of a differential signal path, which imbalance the operation of the amplifier, resulting in a non-zero value of the differential input voltage (VIA+−VIA−), known as the input-referred offset voltage VOS, being required to produce a zero value of the output voltage VOA. The input-referred offset voltage VOS can manifest itself as the voltage difference between the inverting and non-inverting input terminals of a non-ideal amplifier when it is configured to operate in a negative feedback loop.

Returning to FIG. 2, the depicted output amplifiers 52, 56 represent ideal amplifiers, and associated input-referred offset voltages VOS1, VOS2, are depicted as voltage supplies VOS1, VOS2 connected to the respective inverting input terminals. Due to the unity-gain negative-feedback configuration of the output amplifiers 52, 56, the first and second input-referred offset voltages VOS1, VOS2 will also be reflected at the output terminals of the amplifiers 52, 56. Thus, the differential pixel voltage VPIX, i.e., VOUT−VCOM, can be represented as follows: VPIX=VOUT−VCOM=(VSEL2+VOS2)−(VSEL1+VOS1).

One problem, however, associated with the operation of the dual-channel circuit 20A of FIG. 2 is that the pixel voltage VPIX therefore has a limited accuracy. The pixel voltage VPIX includes a first, intentional component (VSEL2−VSEL1) and a second, unintentional component (VOS2−VOS1). However, the first and second offset voltages VOS1, VOS2 are not typically the same, or even correlated, and have values that are not necessarily known in advance of manufacture of the circuit. Thus, the accuracy of the pixel voltage VPIX, i.e., how close in value it comes to the intended component (VSEL2−VSEL1), delivered by the circuit 20A of FIG. 2 is limited because the value of the unintentional component (VOS2−VOS1) is uncertain.

Note that, although the embodiment of FIG. 2 includes particular DAC configurations, other types of video and backplane DAC configurations, and even other dual-channel architectures (i.e., not necessarily involving DACs), are also possible, and can suffer from limited accuracy due to the presence of input-referred offset voltages and related symptoms.

BRIEF DESCRIPTION OF THE DRAWINGS

So that features of the present invention can be understood, a number of drawings are described below. It is to be noted, however, that the appended drawings illustrate only particular embodiments of the invention and are therefore not to be considered limiting of its scope, for the invention may encompass other equally effective embodiments.

DETAILED DESCRIPTION OF EXAMPLE EMBODIMENTS

Figure 3:
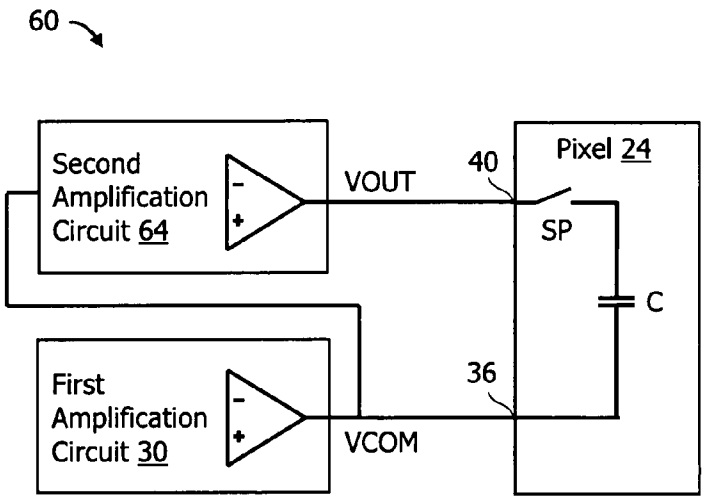
FIG. 3 is a circuit schematic depicting an embodiment of a multi-channel circuit also capable of delivering a differential pixel voltage.

FIG. 3 depicts an embodiment of a multi-channel circuit 60 capable of delivering a higher-accuracy differential pixel voltage VPIX to the LCD pixel 24. Note that, although embodiments of the multi-channel circuit 60 presented herein deliver the accurate differential pixel voltage VPIX to the LCD pixel 24, the multi-channel circuit 60 is capable of delivering accurate differential voltages to any type of load that requires such. Also, although embodiments of the multi-channel circuit 60 presented herein include two channels configured to deliver a single differential signal, other embodiments of the multi-channel circuit 60 can be configured to include more than two channels, and can define a plurality of differential signals.

Figure 1:
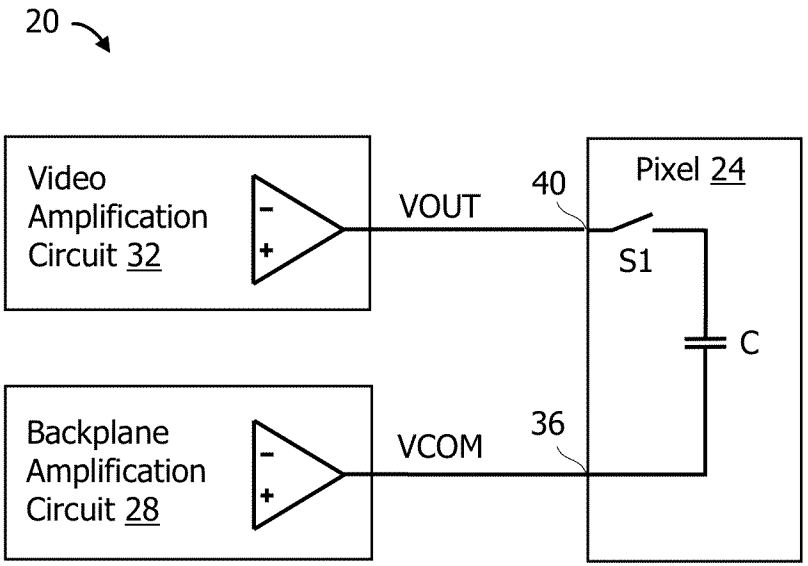
FIG. 1 (Prior Art)
FIG. 1 is a circuit schematic depicting an embodiment of a dual-channel circuit capable of delivering a differential voltage to an LCD pixel.
Figure 2:
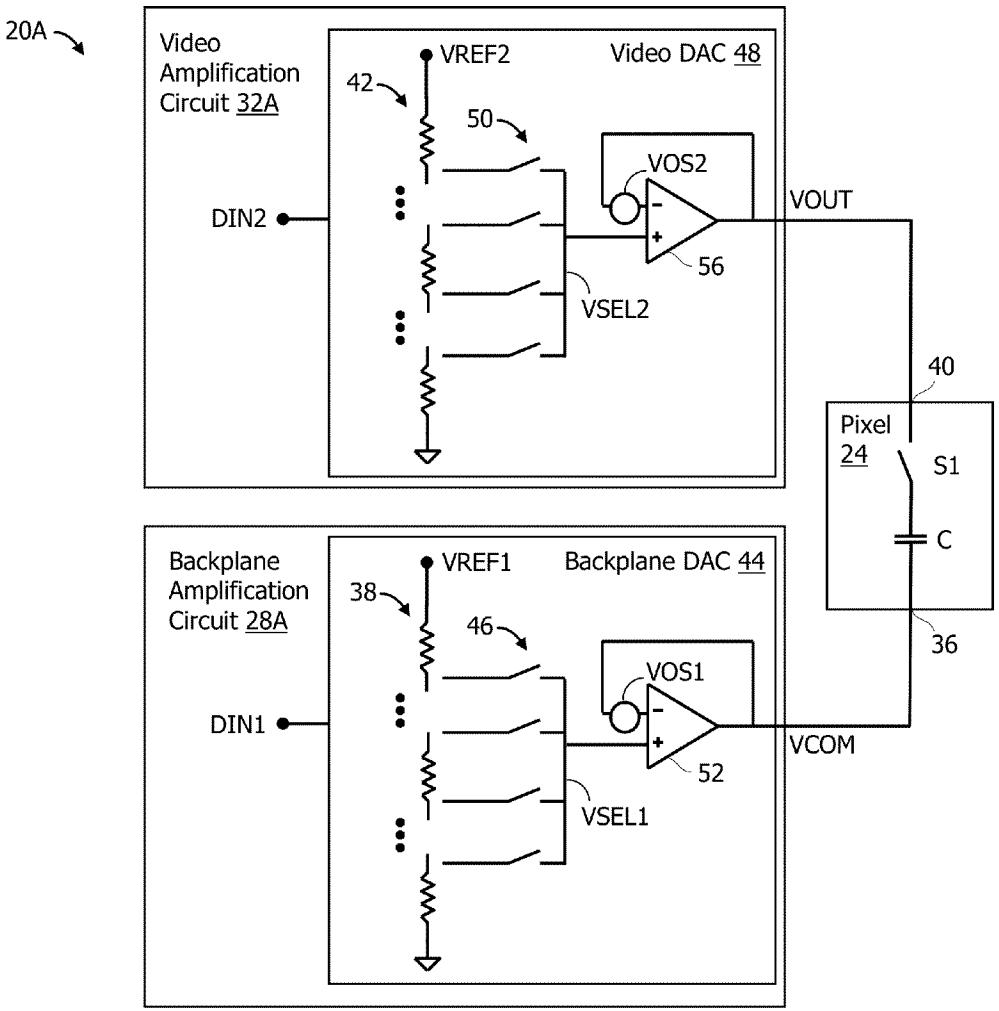
FIG. 2 (Prior Art)
FIG. 2 is a circuit schematic depicting an embodiment of the dual-channel circuit depicted in FIG. 1.

The multi-channel circuit 60 of FIG. 3 includes a first, e.g., backplane, amplification circuit 30 configured to deliver a first, e.g., backplane, signal VCOM to a load, e.g., the pixel 24, and an embodiment 64A of a second, e.g., video, amplification circuit 64 configured to deliver a second, e.g., video, signal VOUT to the load, e.g., pixel 24. The backplane amplification circuit 30 can be any type of circuit configured to deliver a selectable-value voltage signal. For example, the backplane circuit 30 can be substantially the same as the backplane circuit 28A depicted in FIG. 2, and can have an amplifier arranged in a configuration such that an input-referred offset voltage of the amplifier is reflected at an output terminal of the backplane circuit 30. However, although embodiments of the multi-channel circuit 60 advantageously address problems related to such an input-referred offset voltage, embodiments of the multi-channel circuit 60 provide other advantages as well, and thus the backplane circuit 30 does not necessarily need to produce the backplane signal VCOM as a function of an input-referred offset voltage. For example, the backplane circuit 30 can be a substantially different type of circuit than the embodiment 28A depicted in FIG. 2, such as, e.g., a voltage reference circuit, a different type of DAC, or a circuit that receives the backplane signal VCOM from another circuit.

The video circuit 64 of FIG. 3 is configured to deliver the video signal VOUT to the pixel 24 as a function of the backplane signal VCOM. The resulting differential pixel voltage VPIX has an increased accuracy, relative to the embodiment of FIG. 2, because inaccuracies reflected in the backplane signal VCOM, such as, e.g., an input-referred offset voltage, will also be reflected in the video signal VOUT, and thus will, either completely or at least partially (depending on the nature of the dependency of the video signal VOUT on the backplane signal VCOM) cancel out of the pixel voltage VPIX. For example, if the backplane signal VCOM can be represented, as in FIG. 2, as a sum of the first selected voltage VSEL1 and the first input-referred offset voltage VOS1, i.e., VCOM=VSEL1+VOS1; and if the video signal VOUT can be represented by a sum of a first component VOUT1 and a second component f(VCOM) that is a function of the backplane signal VCOM, i.e., VOUT=VOUTI+f(VCOM); then the pixel voltage VPIX can be represented as VPIX=VOUT−VCOM=VOUTI+f(VCOM)−VCOM=VOUTI+f(VSEL1+VOS1)−(VSEL1+VOS1). The dependence of the video signal VOUT on the backplane signal VCOM can then be selected so that the first input-referred offset voltage VOS1 can, either completely or at least partially, cancel out of the representation of the pixel voltage VPIX.

The video circuit 64 can also be configured to compensate for the effect of an input-referred offset voltage VOS of an amplifier internal to itself. In such an embodiment, the first, intended component VOUTI of the video signal VOUT is no longer a function of an input-referred offset voltage, and thus the pixel voltage VPIX, as represented by VPIX=VOUTI+f(VSEL1+VOS1)−(VSEL1+VOS1), can be either partially or completely free of dependence on input-referred offset voltages related to either the backplane or video circuits 30, 64. This is in contrast to the dependency of the pixel voltage VPIX on the first and second input-referred offset voltages VOS1, VOS2 delivered by the dual-channel circuit 20A of FIG. 2.

Figure 4:
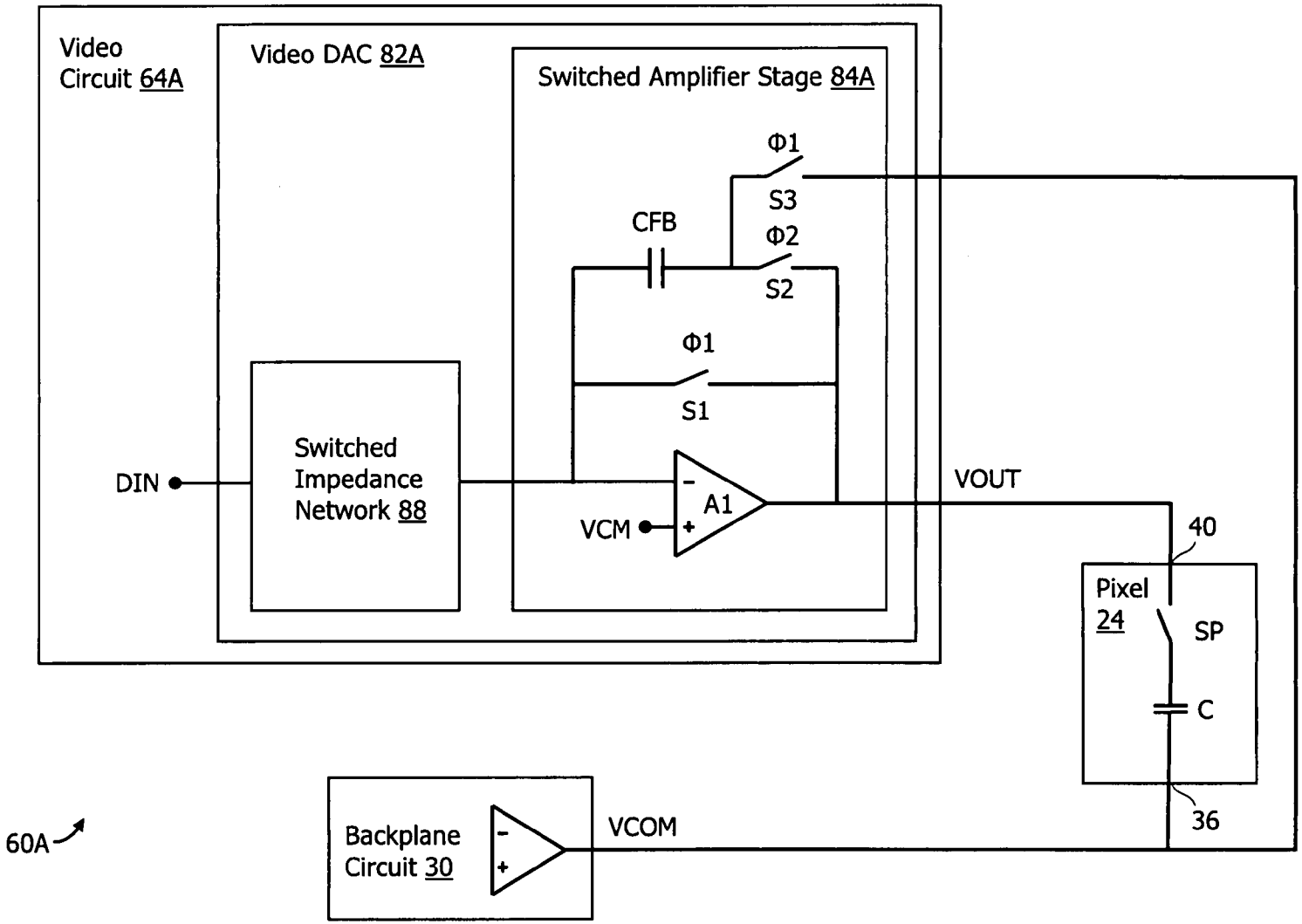
FIG. 4 is a circuit schematic depicting an embodiment of the multi-channel circuit depicted in FIG. 3.

FIG. 4 depicts an embodiment of the multi-channel circuit 60A in which an embodiment of the video circuit 64A includes a video DAC 82A having a switched impedance network 88 and an embodiment of a switched amplifier stage 84A. The switched impedance network 88 is configured to receive a digital input DIN, and the switched amplifier stage 84A is configured to receive the backplane signal VCOM produced by the backplane circuit 30.

Figure 5:
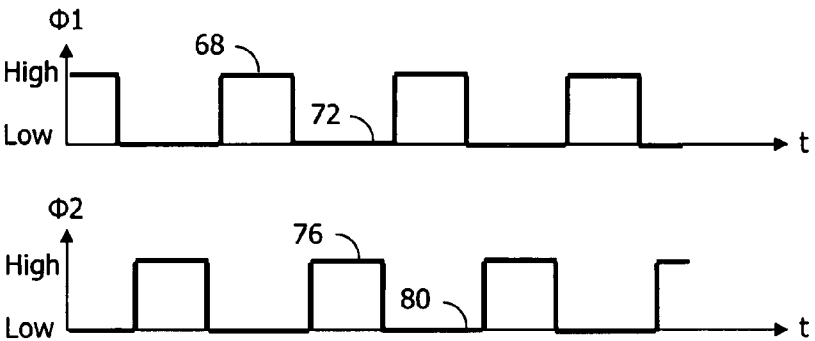
FIG. 5 is a graph depicting an embodiment of first and second clock signals having non-overlapping enable phases.

The multi-channel circuit 60A of FIG. 4, as well as other embodiments of the multi-channel circuit 60 presented herein, is configured to receive, and operate in a switching mode according to, first and second non-overlapping clock signals Φ1, Φ2, exemplary embodiments of which are depicted in FIG. 5. The first clock signal Φ1 has a logic-high enable phase 68 and a logic-low non-enable phase 72, and the second clock signal Φ2 also has a logic-high enable phase 76 and a logic-low non-enable phase 80. The enable phases 68, 76 of the first and second clock signals Φ1, Φ2 are non-overlapping, i.e., temporally mutually-exclusive. A switch configured to receive a particular one of the first and second clock signals Φ1, Φ2 at its switching terminal is enabled, i.e., switched on, during the enable phase of the particular clock signal, and disabled, i.e., switched off, during the non-enable phase of the particular clock signal.

In some switched-capacitor circuits, an overall output of the circuit is considered to be valid during the enable phase of a particular one of the first and second clock signals Φ1, Φ2. For example, embodiments of the multi-channel circuit 60 presented herein can be configured to operate in a mode in which overall output signals, e.g., the generated video and backplane signals VOUT, VCOM, are considered to represent a intended pixel display state during the enable phase 76 of the second clock signal Φ2, and considered to not yet represent the intended pixel display state during the enable phase 68 of the first clock signal Φ1.

Note that the depicted first and second clock signals Φ1, Φ2 are identical to each other except for a 180° phase difference. Thus, assignment of first and second clock signals Φ1, Φ2 to switching terminals of particular switches can be reversed, so long as grouping of particular switches as receiving the same clock signal is maintained. Also, although some switch embodiments are configured to be enabled by a logic-high value received at their switching terminals, other switch embodiments can instead be configured to be enabled by a logic-low value received at their switching terminals.

The switched amplifier stage 84A of FIG. 4 includes first, second and third switches S1, S2, S3, a feedback capacitor CFB, and an amplifier A1 having differential input terminals and a single output terminal. The first switch S1 is enabled during the enable phase 68 of the first clock signal Φ1, and is connected between an output terminal of the amplifier A1 (which is also connected to an output node of the video circuit 64A) and an inverting input terminal of the amplifier A1. The second switch S2 is enabled during the enable phase 76 of the second clock signal Φ2, and is connected between the output terminal of the amplifier A1 and a terminal of the feedback capacitor CFB. A third switch S3 is is enabled during the enable phase 68 of the first clock signal Φ1, and is connected between the same terminal of the feedback capacitor CFB and a circuit node configured to receive the backplane signal VCOM. The inverting input of the amplifier A1 is also connected to the switched impedance network 88, and a non-inverting input of the amplifier A1 is configured to receive a common-mode voltage VCM.

The switched amplifier stage 84A of FIG. 4 is configured to both generate the video signal VOUT as the function of the backplane signal VCOM, and compensate for any input-referred offset voltage of the amplifier A1.

Figure 6:
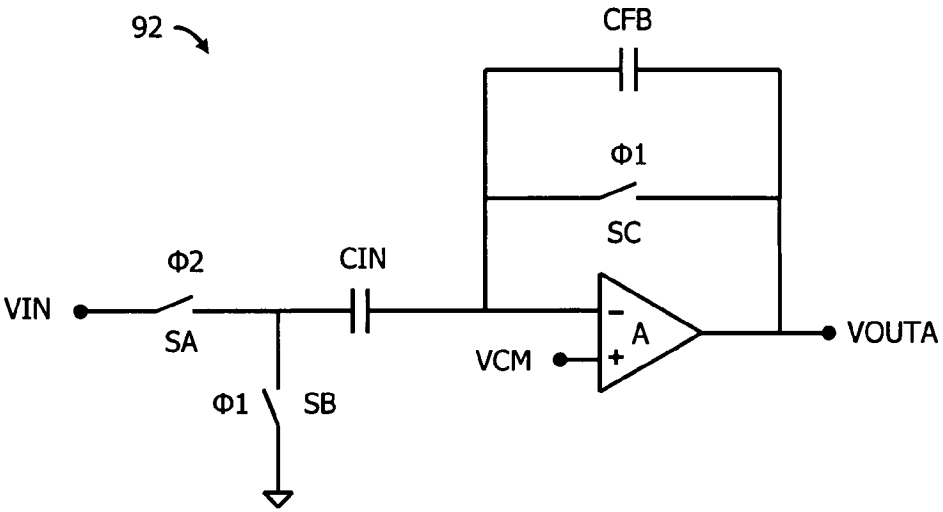
FIG. 6 is a circuit schematic depicting an embodiment of a switched amplifier stage.

To understand how the switched amplifier stage 84A of FIG. 4 compensates for an input-referred offset voltage of the amplifier A1, first consider a switched amplifier stage 92, depicted in FIG. 6, that does not perform such compensation. The non-offset-compensating embodiment of FIG. 6 includes first and second input switches SA, SB, an input capacitor CIN, the feedback capacitor CFB, a feedback switch SC, and an amplifier A having differential input terminals and a single output terminal. The input capacitor CIN is connected between terminals of the first and second input switches SA, SB and an inverting input terminal of the amplifier A. The feedback capacitor CFB and feedback switch SC are connected in parallel between the output terminal of the amplifier A (which is also connected to an output node producing an output voltage VOUTA) and the inverting input terminal. The first and second input switches SA, SB are connected between the input capacitor CIN and an input node (configured to receive an input voltage VIN) and ground, respectively. The second input switch SB and the feedback switch SC are configured to be enabled during the enable phase 68 of the first clock signal Φ1, and the first input switch SA is configured to be enabled during the enable phase 76 of the second clock signal Φ2. A non-inverting input of the amplifier A is configured to receive the common-mode voltage VCM.

Figure 7B:
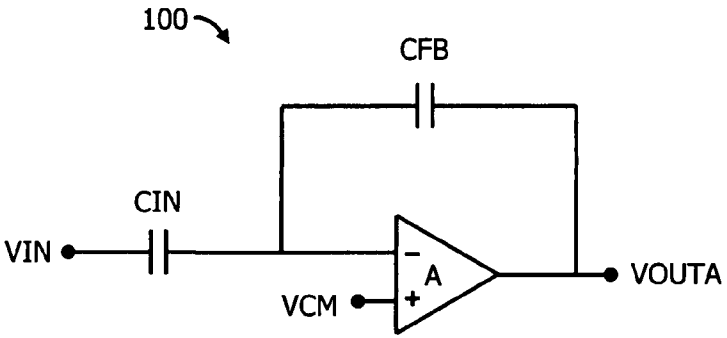
FIGS. 7A and 7B are circuit schematics depicting circuit configurations resulting from the switched amplifier stage of FIG. 6 during the enable phases of the first and second clock signals, respectively.
Figure 7A:
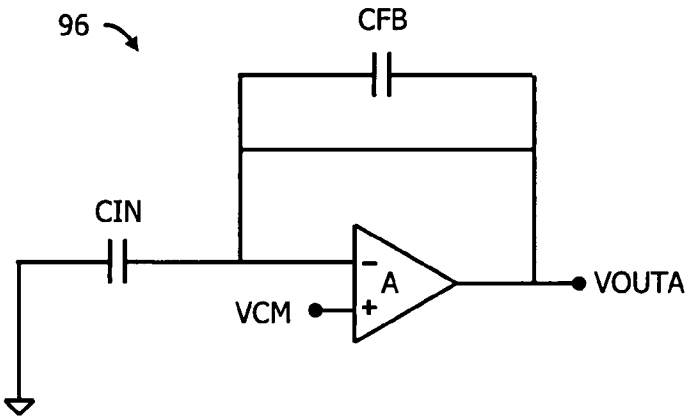

FIGS. 7A and 7B depict circuit configurations 96, 100, assuming ideal switches, resulting from the switched amplifier circuit 92 of FIG. 6 during the enable phases 68, 76 of the first and second clock signals Φ1, Φ2, respectively. An input-to-output transfer function of the switched amplifier circuit 92 of FIG. 6 can be derived using a discrete-time charge-conservation analysis, and can be represented by the following: VOUTA=VCM+VOSA−(CIN/CFB)*VIN; where VOSA is an input-referred offset voltage VOSA appearing between the inverting and non-inverting input terminals as a result of non-idealities of the amplifier A.

Figure 8:
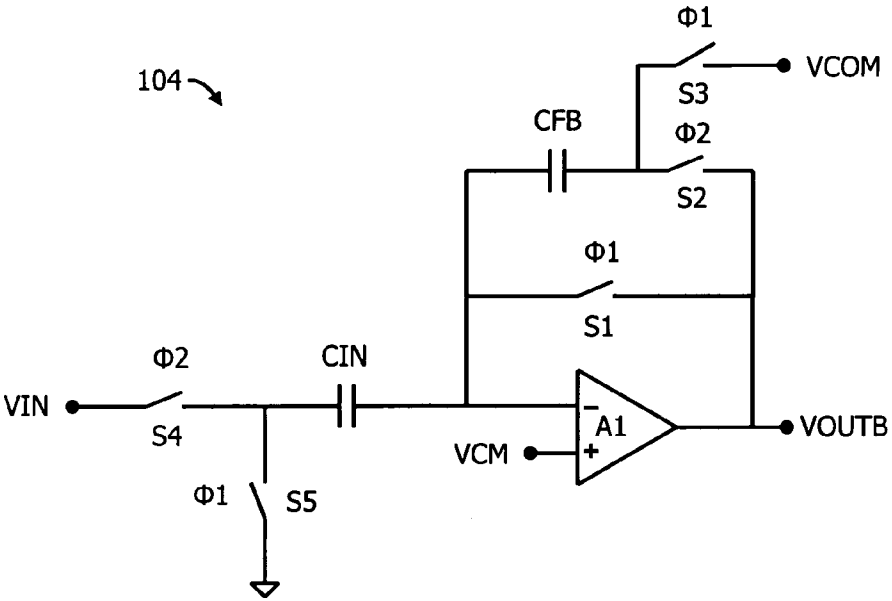
FIG. 8 is a circuit schematic depicting an embodiment of a switched amplifier stage of an embodiment of the multi-channel circuit.
Figure 9B:
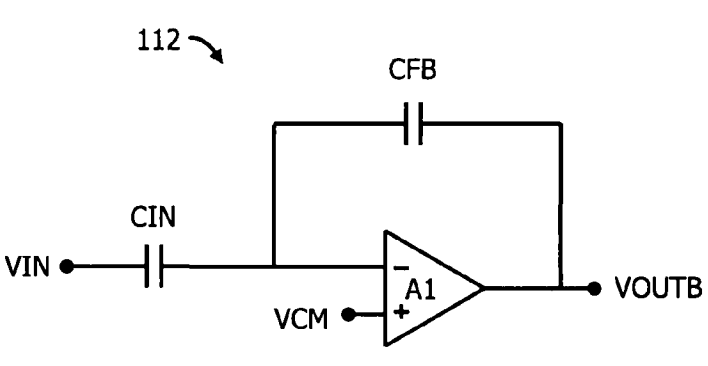
FIGS. 9A and 9B are circuit schematics depicting circuit configurations resulting from the switched amplifier stage of FIG. 8 during the enable phases of the first and second clock signals, respectively.
Figure 9A:
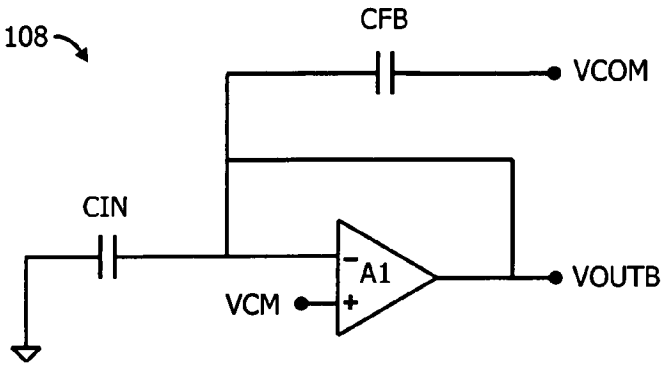

By contrast, FIG. 8 depicts another embodiment of a switched amplifier stage 104, configured similarly to the switched amplifier stage 84A of FIG. 4, but with the switched impedance network 88 instead replaced by the single input capacitor CIN connected between the inverting input terminal of the amplifier A1 and terminals of fourth and fifth switches S4, S5. The other terminals of the fourth and fifth switches S4, S5 are configured to receive the input voltage VIN and ground, respectively, and be enabled during the enable phases 76, 68 of the second and first clock signals Φ2, Φ1, respectively. FIGS. 9A and 9B depict circuit configurations 108, 112, assuming ideal switches, resulting from the switched amplifier stage 104 of FIG. 8 during the enable phases 68, 76 of the first and second clock signals Φ1, Φ2, respectively. An input-to-output transfer function of the switched amplifier stage 104 of FIG. 8 can be derived using a discrete-time charge-conservation analysis, and can be represented by the following: VOUTB=VCOM−(CIN/CFB)*VIN; where VOUTB is the output voltage VOUTB produced at the output terminal of the switched amplifier stage 104.

Thus, the switched amplifier stage 104 of FIG. 8 produces an output voltage VOUTB that is both a function of the backplane video signal VCOM and not a function of any input-referred offset voltage of the amplifier A1.

Returning to FIG. 4, the switched amplifier stage 84A of the video circuit 64A is similarly capable of producing the video signal VOUT as both a function of the backplane signal VCOM and not a function of any input-referred offset voltage of the amplifier A1. The specific dependency of the video signal VOUT on the backplane signal VCOM, produced by the multi-channel circuit 60A of FIG. 4, can be determined by selective implementation of the switched impedance network 88 and other components of the video DAC 84A and video circuit 64A.

Figure 10:
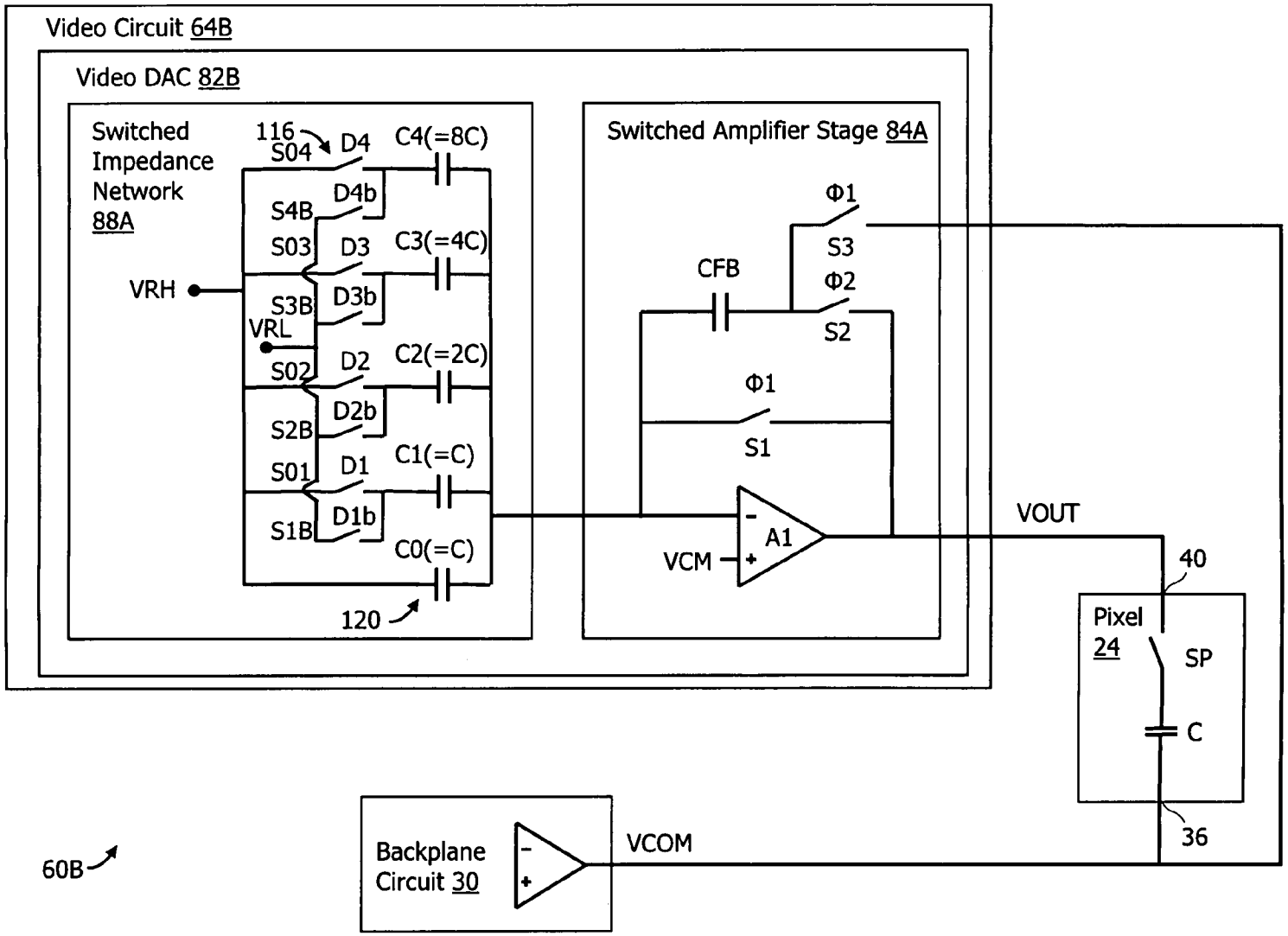
FIG. 10 is a circuit schematic depicting another embodiment of the multi-channel circuit depicted in FIG. 3.

FIG. 10 depicts another embodiment of the multi-channel circuit 60B, including an embodiment of the switched impedance network 88A. The depicted switched impedance network 88A includes a plurality of capacitances 120 selectively connected by a plurality of switches 116 between the input of the switched-capacitor amplifier stage 84A and either a high reference voltage VRH or a low reference voltage VRL. Each of the plurality of switches 116 are configured to receive, at their switching terminals, signals representing individual bits of the digital input DIN. For example, in FIG. 10, the digital input DIN is a four-bit digital input, having a most-significant bit D1, a second-most-significant bit D2, a second-least-significant bit D3, a least-significant bit D4, and complements of each of the bits denoted as D1*b*, D2*b*, D3*b* and D4*b*. The plurality of capacitances 116 have binary-weighted increasing values, e.g., as depicted, zeroeth and first capacitors C0, C1 having a first value (i.e., equal to C), a second capacitor C2 having a second value (i.e., equal to 2C) twice as large as the first value, a third capacitor C3 having a third value (i.e., equal to 4C) twice as large as the second value, and a fourth capacitor C4 having a fourth value (i.e., equal to 8C) twice as large as the third value, and are connected to switches of the plurality of switches 116, according to increasing value, configured to be enabled by decreasingly significant bits of the digital input DIN.

Together, the switched impedance network 88A and the switched amplifier stage 84A of the video DAC 84B convert the digital input DIN into an analog value of the video signal VOUT corresponding to an interpolation between the high reference voltage VRH and the low reference voltage VRL according to the value of the digital input DIN, as follows: VOUT=DIN*(VRH−VRL)+VRL; where for purposes of this formula DIN can be represented as $DIN=D1*2^{-1}+D2*2^{-2}+D3*2^{-3}+D4*2^{-4}$, where each of the individual bits D1, D2, D3, D4 of the digital input DIN can have a value of 0 or 1. So generated, the video signal VOUT is the analog representation of the digital input DIN as framed between the low and high reference voltages VRL, VRH. Note that, although the video DAC 84B of FIG. 10 correspond to a 4-bit digital input DIN, it can be generalized to an N-bit digital input DIN by expanding the switched-impedance network 88A, according to the depicted pattern, to accommodate a greater number of bits. For a generalized N-bit digital input DIN, the video DAC 84B of FIG. 10 can convert the digital input DIN into an analog value of the video signal VOUT as follows: VOUT=DIN*(VRH−VRL)+VRL; where DIN can be represented as $DIN=D1*2^{-1}+D2*2^{-2}+\ldots+DN*2^{-N}$. Note also that other embodiments of the video DAC 84 are possible in which the video signal VOUT is generated as a multiplication of the digital input DIN with a single reference voltage VR, as follows: VOUT=DIN*VR. For example, the low reference voltage VRL in FIG. 10 can be replaced by ground, and in this case the single reference voltage VR becomes equivalent to the depicted high reference voltage VRH.

The video circuit 64 can be configured to operate in a switched mode according to the first and second clock signals Φ1, Φ2. In one embodiment, the video and backplane signals VOUT, VCOM, and thus the pixel signal VPIX, can be considered representative of the intended pixel display state during the enable phase 76 of the second clock signal Φ2, and the video circuit 64 is configured to receive a value of the digital input DIN during the enable phase 76 of the second clock signal Φ2 that is selected to correspond to the intended relative value (e.g., as framed or determined by DC offsets or reference voltages) of the video signal VOUT required to achieve the intended pixel display state.

To further increase the accuracy of the differential pixel signal VPIX delivered by the dual channel circuit 60, the video circuit 64 can also be configured to receive different values of the digital input DIN during each of the non-overlapping enable phases 68, 76 of the first and second clock signals Φ1, Φ2. Although the value of the digital input DIN can be selected in enable phase 76 of the second clock signal Φ2 to be a digital representation of the desired relative value of the analog video signal VOUT for a video display application, during the enable phase 68 of the first clock signal Φ1, the value of the digital input DIN can be changed to a value which is different than the value of the digital input DIN during the enable phase 76 of the second clock signal Φ2, in order to selectively determine characteristics of the video signal VOUT during the enable phase 76 of the second clock signal Φ2, such as, e.g., a DC offset of the video signal VOUT during the enable phase 76 of the second clock signal Φ2.

During the enable phases 68,76 of the first and second clock signals Φ1, Φ2, the video circuit 64B of FIG. 10 has resulting circuit configurations similar to those of FIGS. 9A and 9B, but with differences including that the input capacitance CIN of FIGS. 9A and 9B is replaced by the subset of the plurality of capacitors 120 that are selected by the value of the digital input DIN during each of the enable phases 68, 76 of the first and second clock signals Φ1, Φ2. Furthermore, the selected capacitors are not connected to ground, but instead are connected to either the high or low reference voltage VRH, VRL. Therefore, in embodiments in which the video circuit 64 is configured to receive different values of the digital input DIN during the enable phases 67, 76 of the first and second clock signals Φ1, Φ2, the plurality of capacitors 120 of the video DAC 84B of FIG. 10 are differently selectively connected by the plurality of switches 116 to the high or low reference voltages VRH, VRL, according to the different values of the digital input DIN.

For example, in an illustrative scenario the digital input DIN is selected to have a first value of 0,0,1,1 corresponding to D1,D2,D3,D4 (and thus a value of 1,1,0,0 corresponding to D1*b*,D2*b*,d3*b*,D4*b*) during the enable phase 68 of the first clock signal Φ1, and a second value of 1,1,0,1 (and thus a complement value of 0,0,1,0) during the enable phase 76 of the second clock signal Φ2. In this scenario, during the enable phase 68 of the first clock signal Φ1 the third and fourth capacitors C3, C4 are connected to the high reference voltage VRH by corresponding switches S03, S04, and the first and second capacitors C1, C2 are connected to the low reference voltage VRL by corresponding switches S1B, S2B. During the enable phase 76 of the second clock signal Φ2 the third capacitor C3 is connected to the high reference voltage VRH by corresponding switch S03 and the first, second and fourth capacitors C1, C2, C4 are connected to the low reference voltage VRL by corresponding switches S1B, S2B, S4B. Note that the zeroeth capacitor C0 is always connected to the high reference voltage VRH in the depicted embodiment. Note also that the preceding specific values of the digital input DIN are merely exemplary and discussed only to illustrate the corresponding selective connections of the plurality of capacitors 120.

While the value of the digital input DIN during the enable phase 76 of the second clock signal Φ2 can be selected to correspond to the digital representation of a desired relative analog value of the video signal VOUT during the enable phase 76 of the second clock signal Φ2, the value of the digital input DIN during the enable phase 68 of the first clock Φ1 can be selected to control the DC offset of the overall transfer function of the video DAC 82B during the enable phase 76 of the second clock signal Φ2. Thus, the video DAC 82B can be configured to provide the video signal VOUT as a function of the value of the digital input DIN during the enable phases 68, 76 of both the first and second clock signals Φ1, Φ2. In such an embodiment, the video signal VOUT can be represented as VOUT=f(DIN(Φ1))+f(DIN(Φ2)), where f(DIN(Φ1)) is a first component dependent on the value of the digital input DIN(Φ1) during the enable phase 68 of the first clock signal Φ1, and f(DIN(Φ2)) is a second component dependent on the value of the digital input DIN(Φ2) during the enable phase 76 of the second clock signal Φ2.

Figure 11:
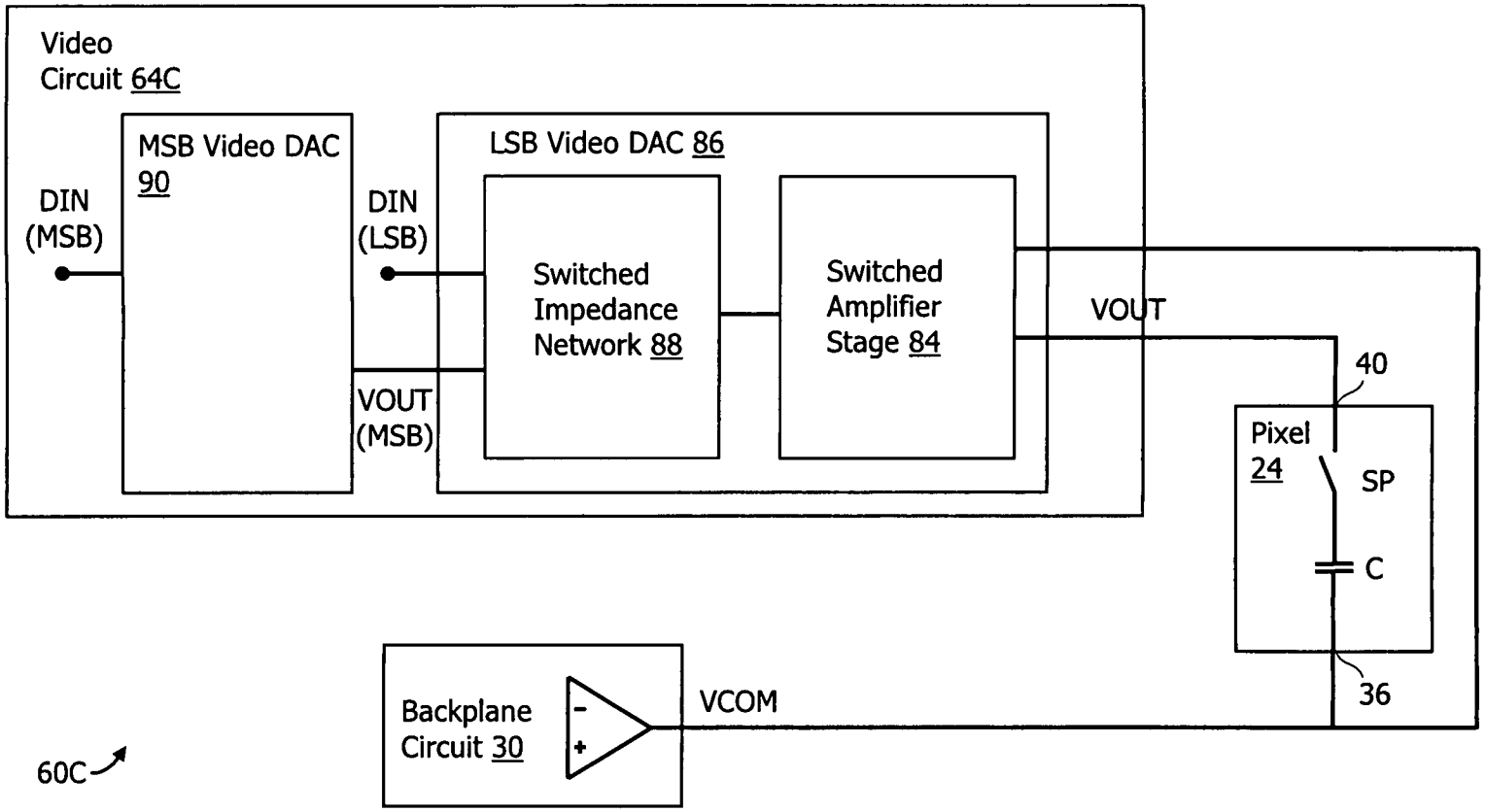
FIG. 11 is a circuit schematic depicting another embodiment of the multi-channel circuit depicted in FIG. 3.

FIG. 11 depicts another embodiment of the multi-channel circuit 60C having an embodiment of the video circuit 60C having a hybrid segmented DAC including a first most-significant bit (MSB) DAC portion 90 configured to receive an MSB portion of the digital input DIN(MSB) and generate a first output voltage VOUT(MSB); and a second, least-significant bit (LSB) DAC portion 86 configured to receive a LSB portion of the digital input DIN(LSB) and the first output voltage VOUT(MSB) and generate the video signal VOUT. As depicted in FIG. 11, the LSB video DAC 86 can be an embodiment of the video DAC 82 depicted in FIGS. 4 and 10, having the switched impedance network 88 and the switched amplifier stage 84.

Figure 12:
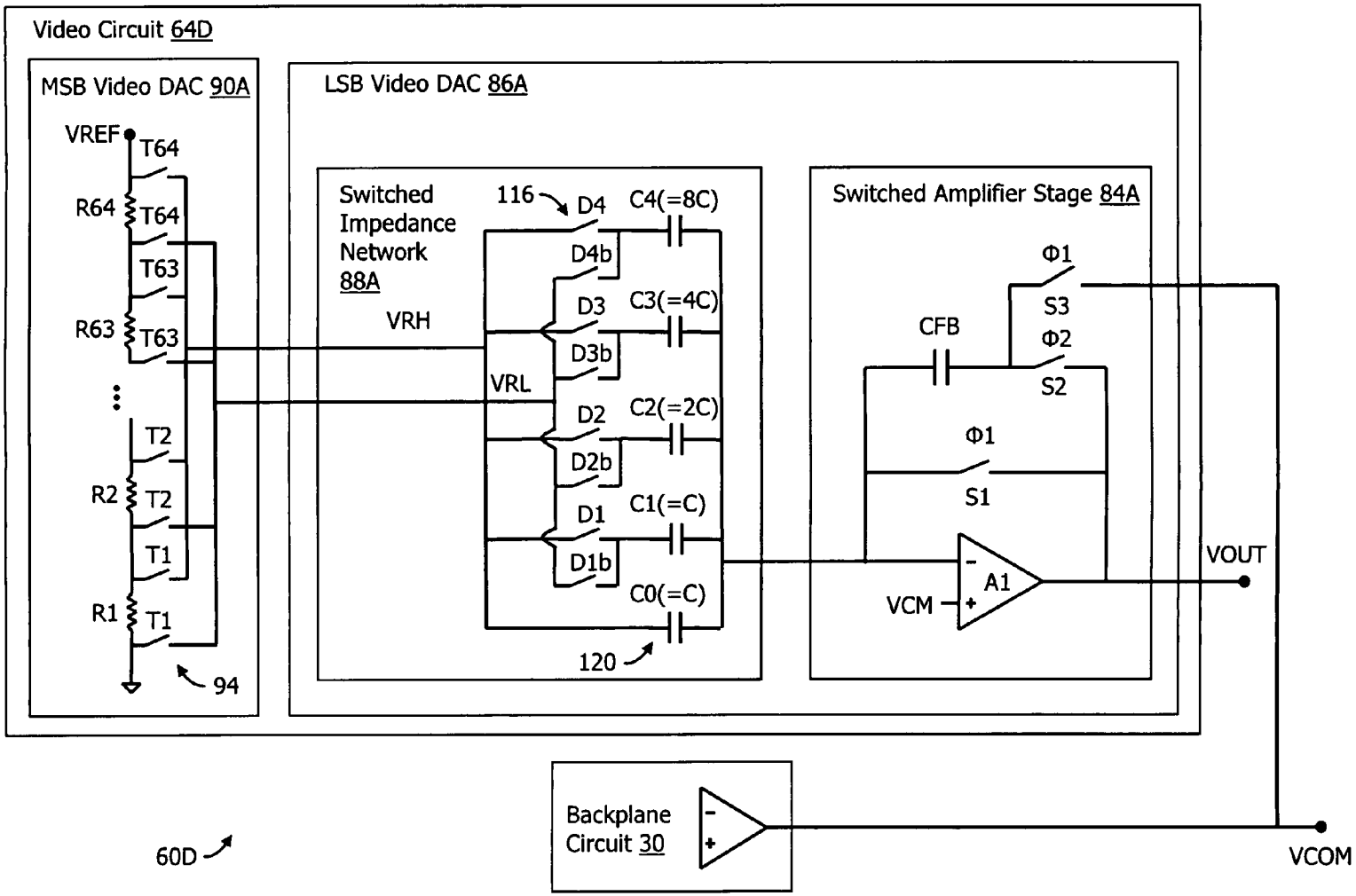
FIG. 12 is a circuit schematic depicting another embodiment of the multi-channel circuit depicted in FIG. 3.

FIG. 12 depicts another embodiment of the multi-channel circuit 60D including an embodiment of the video circuit 60D including possible implementations of the MSB video DAC 90A and LSB video DAC 86A. In FIG. 12, the MSB video DAC 90A includes a string DAC having a plurality of resistors R1, R2, . . . , R63, R64 connected in series from a reference voltage VREF to ground (or, in other embodiments, to a second reference voltage instead of ground) and connected to a plurality of switches 94 configured to receive a plurality of selection signals T1, T2, . . . , T63, T64 representative of a thermometer-coded version of the MSB portion of the digital input DIN(MSB). In FIG. 12, the MSB video DAC 90A generates, as a function of the received MSB portion of the digital input DIN(MSB), the high and low reference voltages VRH, VRL received by the switched impedance network 88A of the LSB video DAC 86A. For example, in an illustrative scenario, if the MSB video DAC 90A receives an 6-bit MSB portion of the digital input DIN(MSB) having a 000001 value, then the first selection signal T1 would have a value enabling the switches receiving that selection signal, and the remaining selection signals T2, . . . , T63, T64 would have values disabling the switches receiving those selection signals. Thus, in the illustrative scenario, the MSB video DAC 90A would generate and deliver a high reference voltage VRH to the LSB video DAC 86A having $1/64^{th}$ of the value of the reference voltage VREF, and would generate and deliver a low reference voltage VRL to the LSB video DAC 86A having a zero value.

The depicted LSB video DAC 86A then uses the received high and low reference voltages VRH, VRL to generate the video signal VOUT as a function of a multiplication of the difference between the received high and low reference voltages VRH, VRL, i.e., VRH−VRL, and the LSB portion of the digital input DIN(LSB), i.e., VOUT=f(DIN(LSB)*(VRH−VRL)).

Thus, the LSB video DAC 86A performs a finer scale interpolating between two coarser values generated by the MSB video DAC 90A.

Note that, although, as depicted in FIG. 12, the MSB video DAC 90A can be configured to receive 6 bits of the digital input DIN, and the LSB video DAC 86A can be configured to receive 4 bits of the digital input DIN, other relative distributions of bits of the digital input DIN between the MSB video DAC 90 and the LSB video DAC 86 are also possible.

Furthermore, the video circuit 64 can also be configured to receive other than a 10-bit digital input DIN.

Returning now to the effect of configuring the video circuit 64 to receive different values of the digital input DIN during the enable phases 68, 76 of the first and second clock signals Φ1, Φ2, a transfer function of the dual-channel circuit 60D of FIG. 12 can be derived using a discrete-time charge-conservation analysis, and can be represented by the following:

$$VOUT=VCOM+(1/CFB)*[CDACH(\Phi1)*VRH(\Phi1)-CDACH(\Phi2)*VRH(\Phi2)]+(1/CFB)*[CDACL(\Phi1)*VRL(\Phi1)-CDACL(\Phi2)*VRL(\Phi2)].$$

In this representation of the video signal VOUT, CDACH(Φ1) is the total equivalent capacitance of the plurality of capacitors 120 of the LSB video DAC 86A that is selectively connected by the LSB portion of the digital input DIN(LSB) to the high reference voltage VRH during the enable phase 68 of the first clock signal Φ1, CDACL(Φ1) is the total equivalent capacitance of the plurality of capacitors 120 that is selectively connected by the LSB portion of the digital input DIN(LSB) to the low reference voltage VRL during the enable phase 68 of the first clock signal Φ1, CDACH(Φ2) is the total equivalent capacitance of the plurality of capacitors 120 that is selectively connected to the high reference voltage VRH by the LSB portion of the digital input DIN(LSB) during the enable phase 76 of the second clock signal Φ2, CDACL(Φ2) is the total equivalent capacitance of the plurality of capacitors 120 that is selectively connected to the low reference voltage VRL by the LSB portion of the digital input DIN(LSB) during the enable phase 76 of the second clock signal Φ2, VRH(Φ1) is the value of high reference voltage VRH delivered to the LSB video DAC 86A by the MSB video DAC 90A as a result of the MSB portion of the digital input DIN(MSB) during the enable phase 68 of the first clock signal Φ1, VRL(Φ1) is the value of the low reference voltage VRL delivered to the LSB video DAC 86A by the MSB video DAC 90A as a result of the MSB portion of the digital input DIN (MSB) during the enable phase 68 of the first clock signal Φ1, VRH(Φ2) is the value of high reference voltage VRH delivered to the LSB video DAC 86A by the MSB video DAC 90A as a result of the MSB portion of the digital input DIN(MSB) during the enable phase 76 of the second clock signal Φ2, and VRL(Φ2) is the value of low reference voltage VRL delivered to the LSB video DAC 86A by the MSB video DAC 90A as a result of the MSB portion of the digital input DIN(MSB) during the enable phase 76 of the second clock signal Φ2.

This representation of the video signal VOUT can be rearranged to yield an expression for the video signal VOUT as a function of the backplane signal VCOM and the digital input DIN, as follows: VOUT=VCOM+(1/CFB)*[(CDACH(Φ1)*VRH(Φ1)+CDACL(Φ1)*VRL(Φ1))−(CDACH(Φ2)*VRH(Φ2)+CDACL(Φ2)*VRL(Φ2))]. In this representation, the terms inside the set of square brackets represent the effect of configuring the video circuit to receive different values of the digital input DIN during the enable phases 68, 76 of the first and second clock signals Φ1, Φ2. The first two terms inside the square brackets, i.e., (CDACH(Φ1)*VRH(Φ1)+CDACL(Φ1)*VRL(Φ1)), represent the effect of the value of the digital input DIN(Φ1) during the enable phase 68 of the first clock signal Φ1, and can be used to control the DC offset of the transfer function of the multi-channel circuit 60. The second two terms inside the square brackets, i.e., (CDACH(Φ2)*VRH(Φ2)+CDACL(Φ2)*VRL(Φ2), represent the effect of the value of the digital input DIN(Φ2) during the enable phase 76 of the second clock signal Φ2, and is representative of the intended relative analog value of the video signal VOUT.

The effect of varying the value of the digital input DIN during the enable phases 68, 76 of the first and second clock signals Φ1, Φ2 can be further understood as follows. The above transfer function can be re-written as follows: VOUT=VCOM+(CDAC/CFB)*VREF*(DIN(Φ1)−DIN(Φ2)); where CDAC is the total equivalent parallel capacitance of the plurality of capacitors 120 of the LSB video DAC 86A, and, for purposes of this equation, both DIN(Φ1) and DIN(Φ2) take the form of $DIN=D1*2^{-1}+D2*2^{-2}+\ldots+DN*2^{-N}$ for an N-bit video circuit (using individual bit values present during the corresponding enable phases 68, 76).

Figure 13:
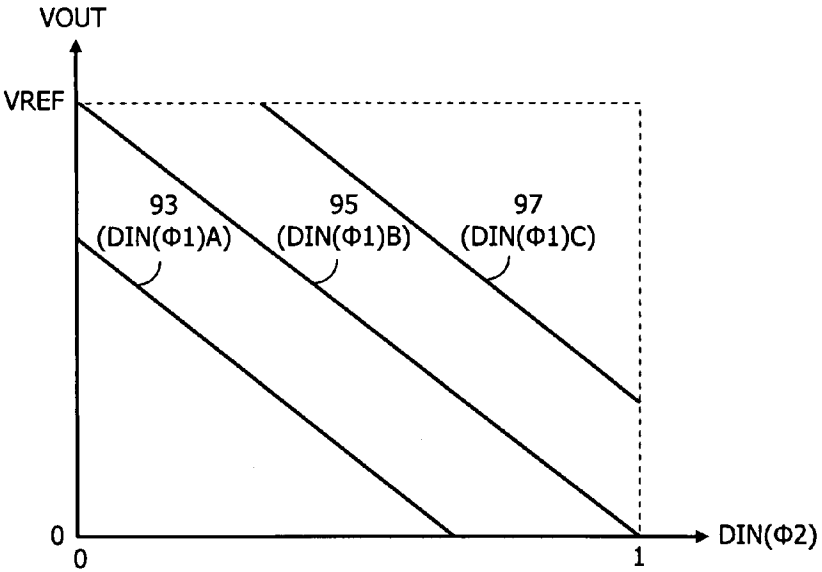
FIG. 13 is a graph depicting an embodiment of a transfer function, for a video signal as a function of a backplane signal, of the multi-channel circuit.

The multi-channel circuit 60 can thus be configured to deliver the video signal VOUT as a function of the backplane signal VCOM, the digital input DIN(Φ1) during the enable phase 68 of the first clock signal Φ1 and the digital input DIN(Φ2) during the enable phase 76 of the second clock signal Φ2. FIG. 13 is a graph depicting an embodiment of this transfer function, plotted with the video signal VOUT on a y-axis and the digital input DIN(Φ2) during the enable phase 76 of the second clock Φ2 signal on an x-axis. In FIG. 13, the transfer function is plotted for three different values of the digital input DIN(Φ1) during the enable phase 68 of the first clock signal Φ1. The middle plot 95 represents the transfer function for a value of the digital input DIN(Φ1)B during the enable phase 68 of the first clock signal Φ1 corresponding to the digital representation of VCOM, as framed by the reference voltage VREF (i.e., DIN(Φ1)B*VREF=VCOM). The first and third plots 93, 97 represent the transfer function for values of the digital input DIN(Φ1)A, DIN(Φ1)C during the enable phase 68 of the first clock signal Φ1 corresponding to values less than and greater than, respectively, the one producing the second plot 95.

In one embodiment, the dual-channel circuit 60 can be configured to operate according to the embodiment of the transfer function depicted by the second plot 95 of FIG. 13. That is, the multi-channel circuit 60 can be configured to receive a value of the digital input DIN(Φ1) during the enable phase 68 of the first clock signal Φ1 that substantially corresponds to the value of the backplane signal VCOM being supplied to the pixel 24 at or about this period of time (e.g., the value of the backplane signal VCOM to be supplied to the pixel 24 during the enable phase 76 of the second clock signal Φ2). Such an embodiment can advantageously provide a balanced transfer function, which can be convenient or desirable for certain applications. In other embodiments, the dual channel circuit 60 can be configured to operate according to other embodiments of the transfer function such as, e.g., embodiments like those depicted by the first and third plots 93, 97 of FIG. 13, i.e., embodiments of the transfer function positioned to the left or right of the second plot 95, for reasons pertaining to specific applications.

Figure 14B:
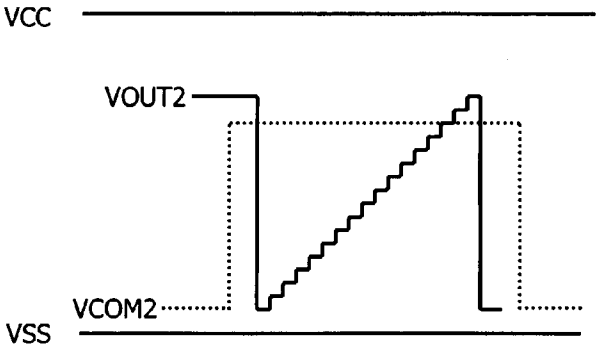
FIGS. 14A and 14B are graphs depicting embodiments of the video and backplane signals delivered by the multi-channel circuit.
Figure 14A:
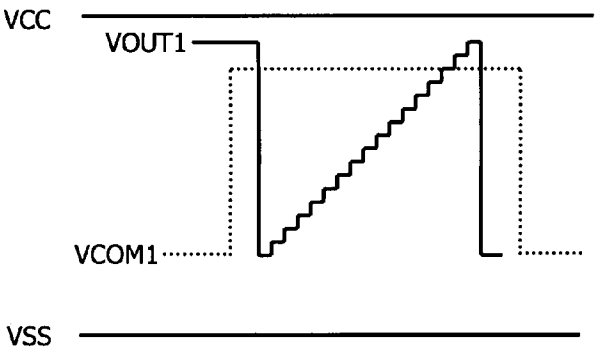

FIGS. 14A and 14B depict embodiments of the video and backplane signals VOUT, VCOM produced by an embodiment of the multi-channel circuit 60, in relation to exemplary upper and lower supply signals VCC, VSS. In FIG. 14A, a first embodiment of the video signal VOUT1 is plotted along with a corresponding first embodiment of the backplane signal VCOM1. In FIG. 14B, a second embodiment of the backplane signal VCOM2 has shifted downward, due to potentially unpredictable or undesirable reasons, such as due to an input-referred offset voltage in an amplifier of the backplane circuit 30, and as a result of the dependence of the video signal VOUT on the backplane signal VCOM produced by the dual-channel circuit 60, a second embodiment of the video signal VOUT2 also shifts down by the same amount, and thus the pixel voltage VPIX supplied to the LCD pixel 24 remains accurate.

Figure 15:
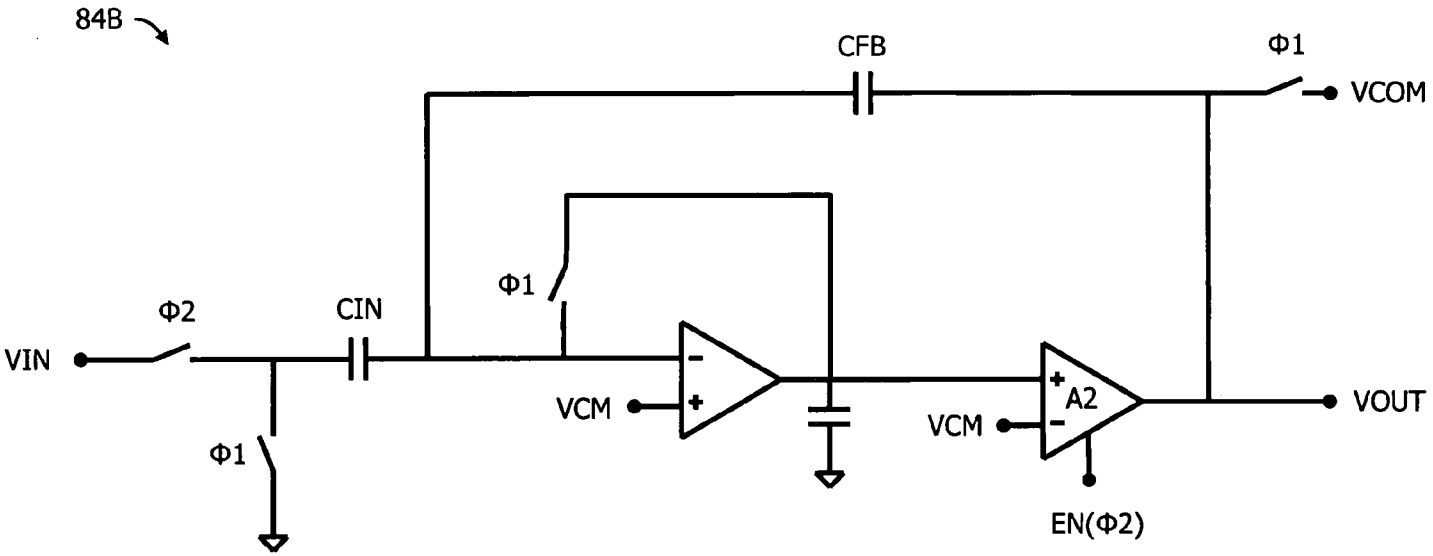
FIG. 15 is a circuit schematic depicting another embodiment of the switched amplifier stage of embodiments of the multi-channel circuit.

Note that, although FIG. 12 depicts specific embodiments of the MSB and LSB video DAC architectures of the multi-channel circuit 60, many other types of DACs can also be used to implement both the MSB and LSB video DACs 86, 90 while still reducing dependence on the effects of input-referred offset voltages and being configurable to receive different values of the digital input DIN during the enable phases 68, 76 of the first and second clock signals Φ1, Φ2. For example, the MSB video DAC 90 can be any type of DAC, and the LSB video DAC 86 can be any type of DAC having an embodiment of the switched amplifier stage 84 capable of sampling the backplane signal VCOM onto a capacitor and compensating for an input-referred offset voltage of an amplifier internal to it. FIG. 15 depicts another embodiment of the switched amplifier stage 84B that can be used to implement the LSB video DAC 86. In FIG. 15, the switched amplifier circuit 84B includes a second amplifier A2 having a tri-state output terminal that is enabled to conduct current only during the enable phase 76 of the second clock signal Φ2.

Figure 16:
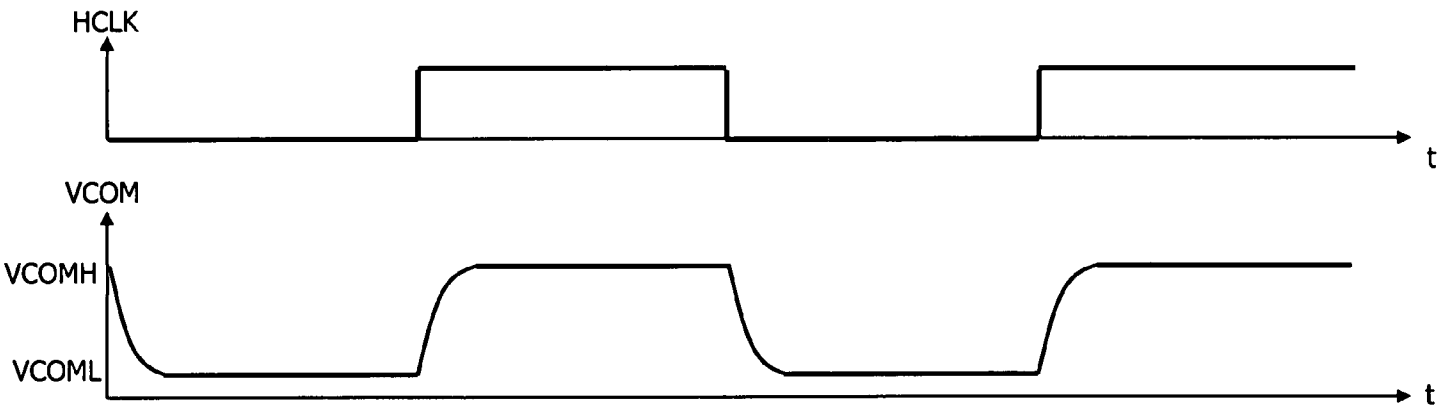
FIG. 16 is a graph depicting an embodiment of a clock signal according to which the backplane signal can be switched between different values.
Figure 18:
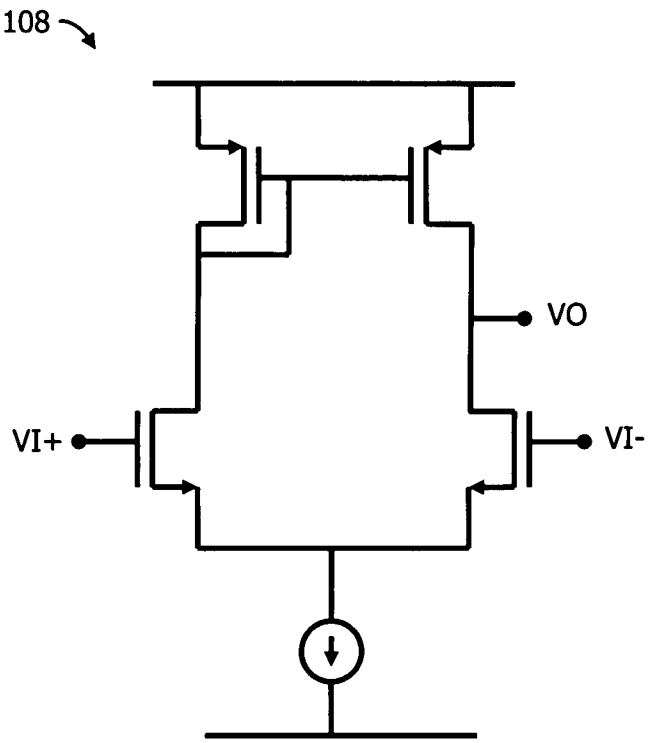
FIG. 18 is a circuit schematic depicting another embodiment of the amplifier of the switched amplifier stage of embodiments of the multi-channel circuit.
Figure 17:
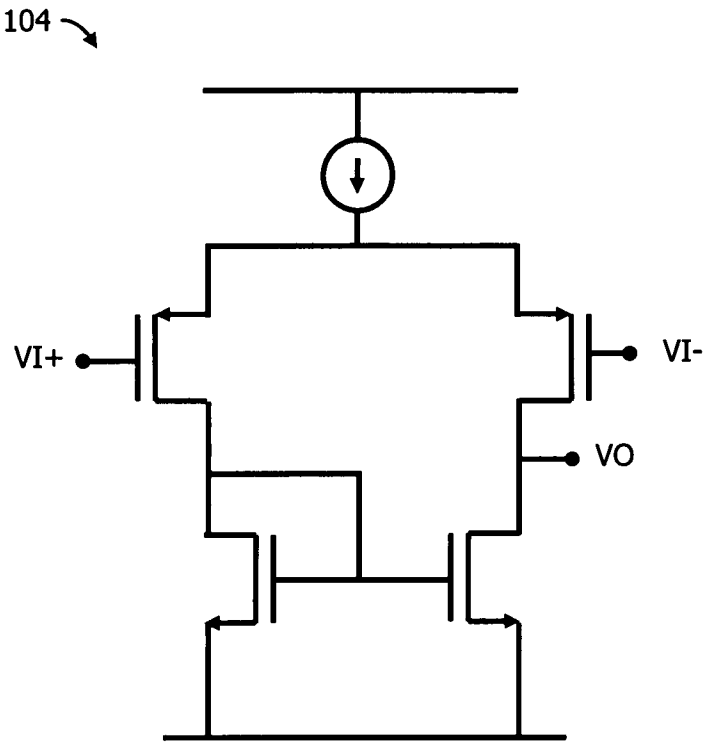
FIG. 17 is a circuit schematic depicting an embodiment of an amplifier of the switched amplifier stage of embodiments of the multi-channel circuit.
Figure 19:
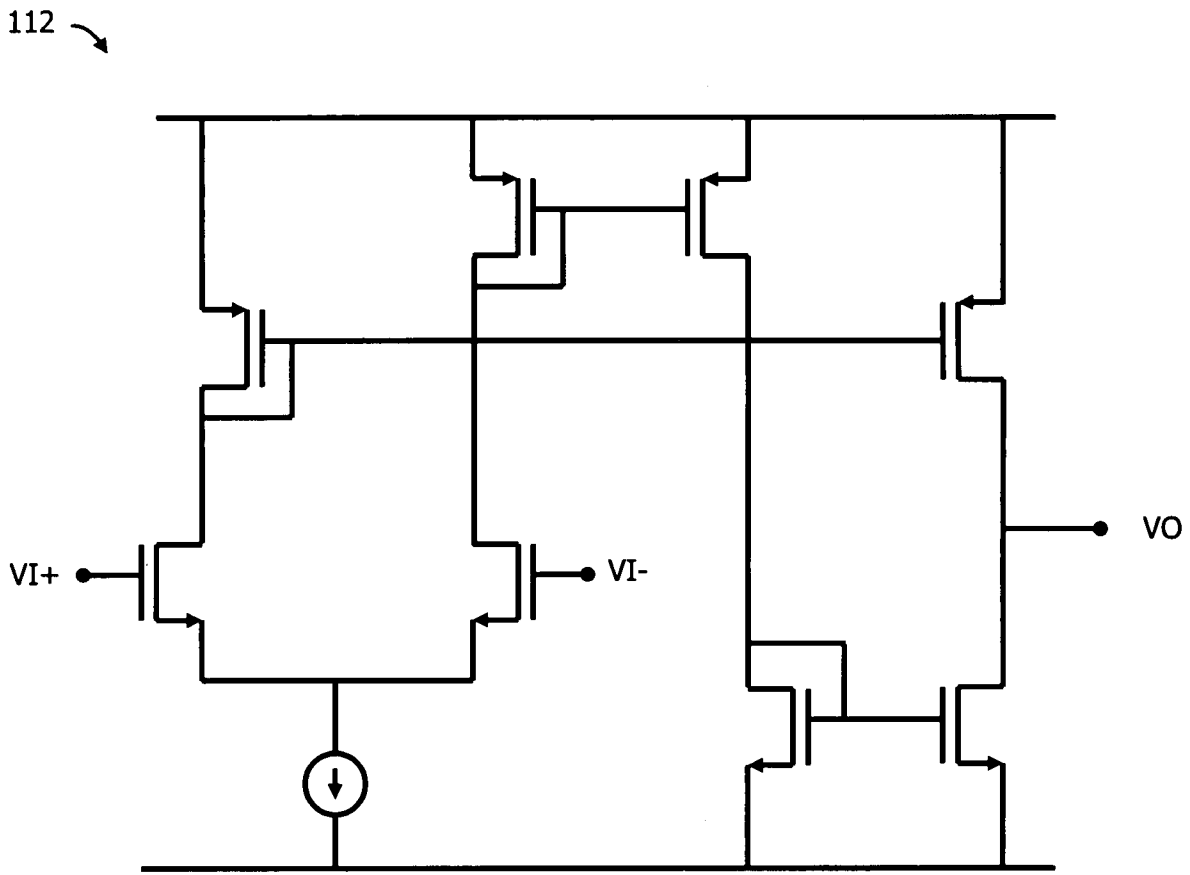
FIG. 19 is a circuit schematic depicting another embodiment of the amplifier of the switched amplifier stage of embodiments of the multi-channel circuit.

The multi-channel circuit 60 can optionally be configured to supply the pixel 24 with a backplane signal VCOM that periodically changes. FIG. 16 depicts an embodiment in which the backplane signal VCOM changes from a high value VCOMH to a low value VCOML according to a corresponding clock signal HCLK.

Note that the value of the video signal VOUT during the enable phase 68 of the first clock signal Φ1 can be selected to have a predetermined value different than the value of the video signal VOUT during the enable phase 76 of the second clock signal Φ2. For example, the value of the video signal VOUT during the enable phase 68 of the first clock signal Φ1 can be selected based on concerns of a specific application of the multi-channel circuit 60.

Figure 20:
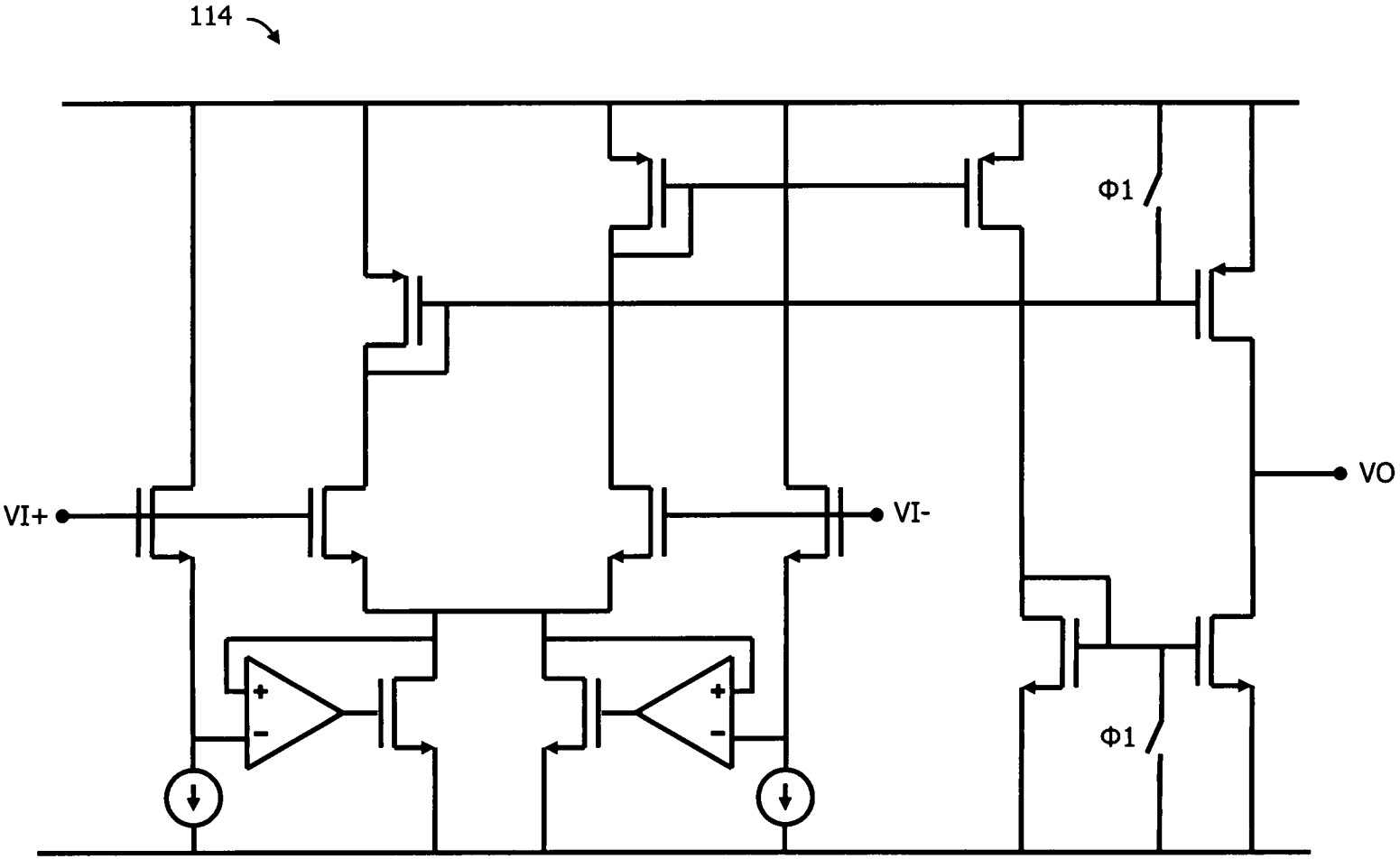
FIG. 20 is a circuit schematic depicting another embodiment of the amplifier of the switched amplifier stage of embodiments of the multi-channel circuit.

FIGS. 17, 18, 19 and 20 depict exemplary embodiments of amplifiers 104, 108, 112, 114, configured to receive differential input voltages VI+, VI− and generate a single-ended output voltage VO, which can be used to implement the amplifiers, e.g., amplifier A1, in embodiments of the switched amplifier stage 84 of the multi-channel circuit 60. The embodiment of FIG. 20 can also be used to implement the amplifier A2, having the tri-state output terminal, of the embodiment of the switched amplifier stage of FIG. 15. In FIG. 20, a pair of switches are configured to be enabled during the enable phase 68 of the first clock signal Φ1 to produce the tri-state output terminal enabled to conducting current substantially only during the enable phase 76 of the second clock signal Φ2.

Figure 21:
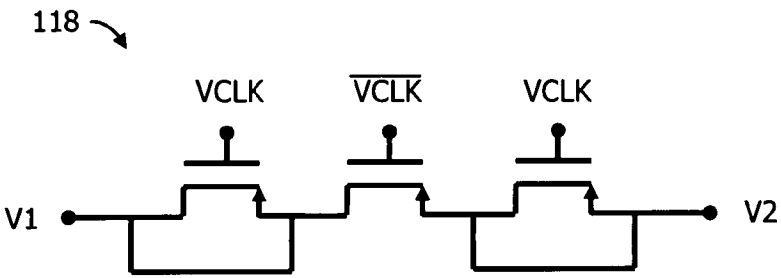
FIG. 21 is a circuit schematic depicting an embodiment of a switch of embodiments of the multi-channel circuit.
Figure 22:
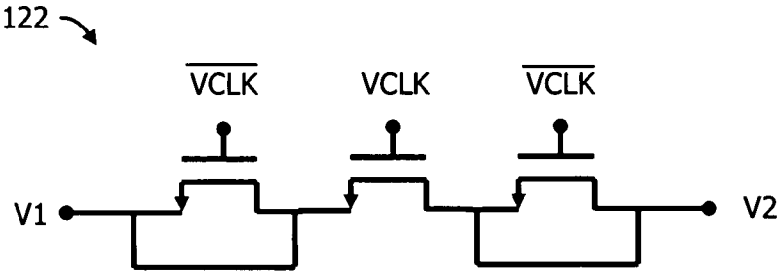
FIG. 22 is a circuit schematic depicting another embodiment of the switch of embodiments of the multi-channel circuit.
Figure 23:
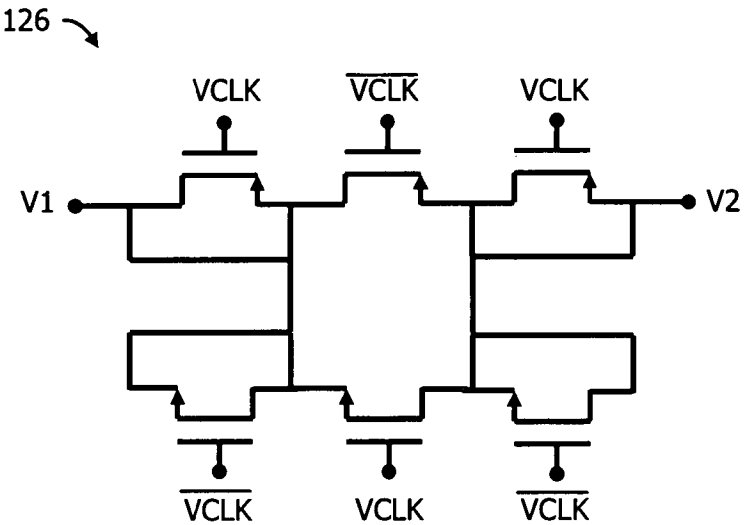
FIG. 23 is a circuit schematic depicting another embodiment of the switch of embodiments of the multi-channel circuit.

FIGS. 21, 22 and 23 depict embodiments of transistor-based switches 118, 122, 126 suitable for implementing switches, operative to receive clock signal VCLK and its complement, of embodiments of the multi-channel circuit 60. The embodiment 118 of FIG. 21 includes PMOS transistors, and can be suitable, e.g., for passing low voltages. The embodiment 122 of FIG. 22 includes NMOS transistors, and can be suitable, e.g., for passing high voltages. The embodiment 126 of FIG. 23 includes both NMOS and PMOS transistors, and can be suitable, e.g., for passing signals that swing rail-to-rail. All three depicted embodiments 118, 122, 126 include dummy devices to soak up excess channel charge and decrease the effects of charge injection. Other transistor-based switch embodiments can also be used to implement switches of embodiments of the multi-channel circuit 60.

Figure 24:
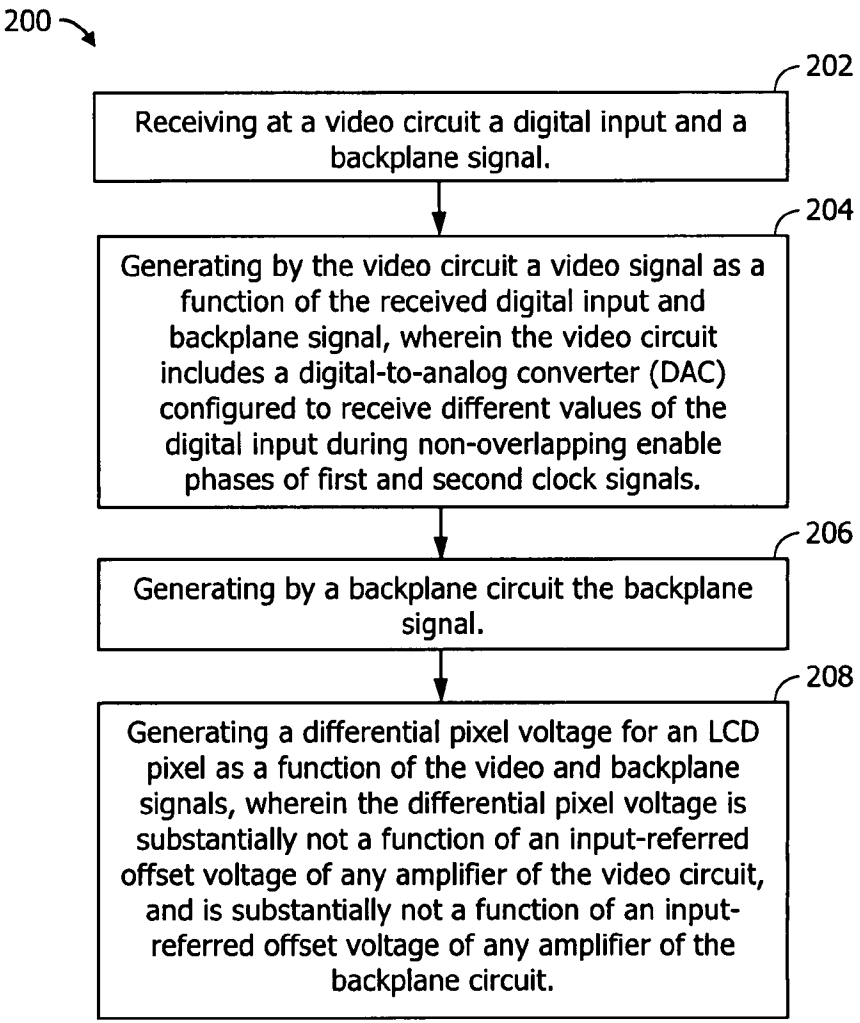
FIG. 24 is a flowchart depicting an embodiment of a method.

FIG. 24 is a flow chart depicting an embodiment of a method 200 for supplying the differential pixel voltage VPIX to the LCD pixel 24. A first step 202 includes receiving at the video circuit 64 the digital input DIN and the backplane signal VCOM. A second step 204 includes generating by the video circuit 64 the video signal VOUT as a function of the received digital input DIN and backplane signal VCOM, wherein the video circuit 64 includes a DAC (e.g., video DAC 84, and/or LSB video DAC 86 and MSB video DAC 90) configured to receive different values of the digital input DIN during the non-overlapping enable phases 68, 76 of the first and second clock signals Φ1, Φ2. A third step 206 includes generating by the backplane circuit 30 the backplane signal VCOM. A fourth step 208 includes generating the differential pixel voltage VPIX as a function of the video and backplane signals VOUT, VCOM, wherein the differential pixel voltage VPIX is substantially not a function of an input-referred offset voltage of any amplifier of the video circuit 64, and is substantially not a function of an input-referred offset voltage of any amplifier of the backplane circuit 30.

Further embodiments are also possible, which are the result of subsets of elements of, or variously combining elements of, embodiments described herein. For example, although the multi-channel circuit 60 is described herein as producing the video signal VOUT and the backplane signal VCOM to generate the pixel voltage VPIX for the LCD pixel 24, the multi-channel circuit 60 can also be configured to deliver more accurate relative first and second signals to other types of loads in other types of applications. Additionally, the multi-channel circuit 60 can also be configured to produce more than two accurate relative signals. For example, the multi-channel circuit 60 can be configured to produce a plurality of first signals relative to a single second signal, or a plurality of first signals relative to a plurality of second signals.

What is claimed is:

1. A differential pixel-driver circuit, comprising:

a first circuit to receive a multi-bit digital input, first and second clock signals having non-overlapping enable phases, and a second pixel-drive output voltage, the second pixel-drive output voltage being coupled to the first circuit via a switch enabled during the enable phase of the first clock signal, and generate a first pixel-drive output voltage as a function of the received multi-bit digital input and the second pixel-drive output voltage, the first circuit including a digital-to-analog converter (DAC) configured to receive different values of the multi-bit digital input during respective non-overlapping enable phases of the first and second clock signals;

a second circuit to generate the second pixel-drive output voltage; and output terminals to provide the first and second pixel-drive output voltages to differentially drive a pixel according to a difference between the first and second pixel-drive output voltages.

2. The differential pixel-driver circuit of claim 1, wherein the DAC is configured to receive a first value of the multi-bit digital input during the enable phase of the first clock signal to control a DC offset of the first pixel-drive output voltage during the enable phase of the second clock signal, and receive a second value of the multi-bit digital input during the enable phase of the second clock signal that is a digital representation of the first pixel-drive output voltage during the enable phase of the second clock signal.

3. The differential pixel-driver circuit of claim 1, wherein the first circuit is configured to generate the first pixel-drive output voltage such that the first pixel-drive output voltage has (i) a DC-offset component that is a function of a value of the multi-bit digital input received during the enable phase of the first clock signal, and (ii) a non-DC-offset component that is a function of a value of the multi-bit digital input received during the enable phase of the second clock signal.

4. A differential pixel-driver circuit, comprising:

a first circuit to receive a multi-bit digital input and a second pixel-drive output voltage, and to generate a first pixel-drive output voltage as a function of the received digital input and the second pixel-drive output voltage;

a second circuit to generate the second pixel-drive output voltage; and output terminals to provide the first and second pixel-drive output voltages to differentially drive a pixel according to a difference between the first and second pixel-drive output voltages, wherein the first circuit includes a switched amplifier stage having an amplifier and a feedback capacitor, the switched amplifier stage configured to receive the second pixel-drive output voltage via a switch enabled during an enable phase of a clock signal, produce the first pixel-drive output voltage at one of the output terminals, and connect the second pixel-drive output voltage to the feedback capacitor.

5. The differential pixel-driver circuit of claim 1, wherein the first circuit includes a hybrid segmented DAC having a most-significant bit (MSB) DAC portion and a least-significant bit (LSB) DAC portion, wherein the MSB DAC portion includes a resistor string connected to a plurality of switches configured to receive signals corresponding to a thermometer-coded representation of a MSB portion of the multi-bit digital input, and the LSB DAC portion includes a switched impedance network having a plurality of capacitances connected to a plurality of switches configured to receive signals corresponding to an LSB portion of the multi-bit digital input.

6. The differential pixel-driver circuit of claim 1, wherein the second circuit includes an amplifier and generates the second output voltage as a function of an input-referred offset voltage of the amplifier.

7. The differential pixel-driver circuit of claim 1, wherein the first circuit is a video circuit configured to produce the first pixel-drive output voltage as a video signal, and the second circuit is a backplane circuit configured to produce the second pixel-drive output voltage as a backplane signal.

8. A method of supplying a differential pixel-drive voltage to a pixel, the method comprising:

receiving at a first circuit a multi-bit digital input, first and second clock signals having non-overlapping enable phases, and a second pixel-drive output voltage, the second pixel-drive output voltage being coupled to the first circuit via a switch enabled during the enable phase of the first clock signal, wherein the first circuit includes a digital-to-analog converter (DAC) configured to receive different values of the multi-bit digital input during respective non-overlapping enable phases of the first and second clock signals;

generating by the first circuit a first pixel-drive output voltage as a function of the received multi-bit digital input and second pixel-drive output voltage;

generating by a second circuit the second pixel-drive output voltage; and providing the differential pixel-drive voltage as a difference between the first and second pixel-drive output voltages.

9. The method of claim 8, further comprising receiving by the DAC a value of the multi-bit digital input during the enable phase of the first clock signal to control a DC offset of the first pixel-drive output voltage during the enable phase of the second clock signal, and receiving by the DAC a value of the multi-bit digital input during the enable phase of the second clock signal that is a digital representation of the first pixel-drive output voltage during the enable phase of the second clock signal.

10. The method of claim 8, further comprising generating by the first circuit the first pixel-drive output voltage such that the first pixel-drive output voltage has (i) a DC-offset component that is a function of a value of the multi-bit digital input received during the enable phase of the first clock signal, and (ii) a non-DC-offset component that is a function of a value of the multi-bit digital input received during the enable phase of the second clock signal.

11. The method of claim 8, further comprising:

receiving, by a switched-capacitor amplifier stage of the first circuit, the second pixel-drive output voltage;

producing the first pixel-drive output voltage at an output terminal of the switched-capacitor output stage; and connecting the second pixel-drive output voltage to a feedback capacitor of the switched-capacitor amplifier stage.

12. The method of claim 8, wherein the first circuit includes a hybrid segmented digital-to-analog converter (DAC) having a most-significant bit (MSB) DAC portion and a least-significant bit (LSB) DAC portion, wherein the MSB DAC portion includes a resistor string connected to a plurality of switches configured to receive signals corresponding to a thermometer-coded representation of a MSB portion of the multi-bit digital input, and the LSB DAC portion includes a switched impedance network having a plurality of capacitances connected to a plurality of switches configured to receive signals corresponding to an LSB portion of the multi-bit digital input.

13. A method of supplying a differential pixel-drive voltage to a pixel, the method comprising:

receiving by a first circuit a multi-bit digital input and a second pixel-drive output voltage, wherein the first circuit includes a switched amplifier stage having an amplifier and a feedback capacitor, the switched amplifier stage receiving the second pixel-drive output voltage via a switch enabled during an enable phase of a clock signal and connecting the second pixel-drive output voltage to the feedback capacitor;

generating by the first circuit a first pixel-drive output voltage as a function of the received multi-bit digital input and the second pixel-drive output voltage;

generating by a second circuit the second pixel-drive output voltage; and providing at a pair of output terminals the first and second pixel-drive output voltages to differentially drive the pixel according to a difference between the first and second pixel-drive output voltages.

14. A differential pixel-driver circuit, comprising:

a first circuit to receive a digital input, first and second clock signals having non-overlapping enable phases, and a second pixel-drive output voltage, the second pixel-drive output voltage being coupled to the first circuit via a switch enabled during the enable phase of the first clock signal, and generate a first pixel-drive output voltage as a function of the received digital input and the second pixel-drive output voltage;

a second circuit to generate the second pixel-drive output voltage; and output terminals to provide the first and second pixel-drive output voltages to differentially drive a pixel according to a difference between the first and second pixel-drive output voltages.

15. A method of supplying a differential pixel-drive voltage to a pixel, the method comprising:

receiving at a first circuit a digital input, first and second clock signals having non-overlapping enable phases, and a second pixel-drive output voltage, the second pixel-drive output voltage being coupled to the first circuit via a switch enabled during the enable phase of the first clock signal;

generating by the first circuit a first pixel-drive output voltage as a function of the received digital input and the second pixel-drive output voltage;

generating by a second circuit the second pixel-drive output voltage; and providing the differential pixel-drive voltage as a difference between the first and second pixel-drive output voltages.

* * * * *